US011000134B2

(12) United States Patent
Johnson et al.

(10) Patent No.: US 11,000,134 B2
(45) Date of Patent: May 11, 2021

(54) TIERED DISPLAY UNIT

(71) Applicant: Target Brands, Inc., Minneapolis, MN (US)

(72) Inventors: Jason W. Johnson, Wayzata, MN (US); Blake M. Johnson, St. Paul, MN (US); Jeremiah J. Albrecht, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 42 days.

(21) Appl. No.: 16/196,146

(22) Filed: Nov. 20, 2018

(65) Prior Publication Data

US 2020/0154908 A1 May 21, 2020

(51) Int. Cl.

| | |
|---|---|
| ***A47F 5/10*** | (2006.01) |
| ***A47F 3/00*** | (2006.01) |
| ***A47F 3/06*** | (2006.01) |
| ***A47F 5/00*** | (2006.01) |

(52) U.S. Cl.

CPC ..... *A47F 5/10* (2013.01); *A47F 3/004* (2013.01); *A47F 3/06* (2013.01); *A47F 5/0043* (2013.01)

(58) Field of Classification Search

CPC ..... A47F 5/10; A47F 5/0043; A47F 5/103; A47F 5/0025; A47F 5/0062; A47F 3/004; A47F 3/06; G09F 15/0068

See application file for complete search history.

(56) References Cited

U.S. PATENT DOCUMENTS

| | | | | |
|---|---|---|---|---|
| 1,477,428 | A | 12/1923 | Corbett | |
| D93,082 | S | 5/1934 | Wright | |
| D122,189 | S | 3/1940 | Vaughn | |
| D156,544 | S | 9/1949 | Lebow | |
| D158,777 | S | 5/1950 | Malkin | |
| D173,627 | S | 12/1954 | Nichols | |
| 2,919,034 | A | 12/1959 | Levy | |
| 2,998,107 | A | 8/1961 | Zimmerla | |
| D192,623 | S | 4/1962 | De Nys | |
| 3,081,718 | A * | 3/1963 | Shoffner | A47F 5/103 108/108 |
| 3,297,374 | A * | 1/1967 | Radek | A47F 5/103 312/108 |
| 3,667,826 | A | 6/1972 | Wood et al. | |
| D231,760 | S | 6/1974 | Molzen | |
| D279,528 | S | 7/1985 | Kingsley | |
| D286,834 | S | 11/1986 | Wilken | |
| D297,084 | S | 8/1988 | Silver | |

(Continued)

*Primary Examiner* — Patrick D Hawn

(74) *Attorney, Agent, or Firm* — Leanne Taveggia Farrell; Westman, Champlin & Koehler, P.A.

(57) ABSTRACT

A tiered display unit includes a frame assembly. The frame assembly includes a first side support structure having a plurality of support members that form at least one tier, a second side support structure having a plurality of support members that form at least one tier and a plurality of cross members that connect the first support structure to the second support structure. Select cross members of the plurality of cross members include a pair of elongated components that are spaced apart from each other and occupy an area that is the same as the non-selected cross members. The space between the pairs of elongated components of the select cross members are configured to receive hooks for mating display accessories to the frame assembly.

14 Claims, 12 Drawing Sheets

(56) References Cited

U.S. PATENT DOCUMENTS

D302,632 S 8/1989 Rees
4,925,038 A 5/1990 Gajewski
5,048,699 A 9/1991 Trevaskis
D326,965 S * 6/1992 Allen ..... D6/682.6
5,272,991 A 12/1993 Carrigan, Jr.
5,314,080 A * 5/1994 Wentworth ..... A47F 5/0062 211/181.1
D372,815 S 8/1996 Bird et al.
5,553,723 A 9/1996 Stein
D393,554 S 4/1998 Baluk et al.
D398,461 S 9/1998 Baluk et al.
D398,462 S 9/1998 Baluk et al.
5,881,892 A * 3/1999 Loo ..... A47F 5/0025 211/126.13
5,918,750 A 7/1999 Jackson
6,029,833 A 2/2000 Yeh
D427,824 S 7/2000 Osburn et al.
D431,396 S 10/2000 Guttman et al.
6,364,137 B1 4/2002 Glauth et al.
6,427,857 B1 * 8/2002 Adams ..... A47F 5/10 211/162
6,561,366 B2 * 5/2003 Kim-So ..... A47F 5/10 211/189
6,607,083 B1 * 8/2003 Webb ..... A47F 1/12 108/107
6,783,012 B2 8/2004 Webb
7,540,510 B2 * 6/2009 Sparkowski ..... A47F 5/137 108/106
D602,713 S * 10/2009 Stukenberg ..... D6/681.1
D624,334 S 9/2010 Linder
7,810,658 B2 * 10/2010 Clark ..... A47F 5/137 211/189
7,946,435 B2 * 5/2011 Clark ..... A47F 5/103 211/189
7,988,000 B2 * 8/2011 Clark ..... A47F 5/137 211/189
8,919,583 B2 * 12/2014 Brasher ..... A47F 5/083 211/106
8,959,813 B2 * 2/2015 Denby ..... A47F 5/10 211/175
D734,958 S 7/2015 Gosling et al.
9,119,487 B2 * 9/2015 Angvall ..... A47F 5/0081
D758,105 S 6/2016 Taraczky
10,104,988 B2 * 10/2018 Knudsen ..... A47F 7/0042
D834,859 S 12/2018 Hawkins
D844,349 S 4/2019 Burton et al.
D848,768 S 5/2019 Johnson et al.
D866,226 S 11/2019 Burton et al.
10,477,984 B2 11/2019 Arnold
2003/0196972 A1 * 10/2003 Webb ..... A47F 5/01 211/59.2
2005/0000924 A1 * 1/2005 Webb ..... A47F 5/01 211/59.2
2005/0039390 A1 * 2/2005 Sharples ..... A47F 5/10 47/39
2005/0230338 A1 * 10/2005 Farinola ..... A47F 5/0838 211/186
2007/0170139 A1 * 7/2007 Clark ..... A47F 5/137 211/189
2008/0128414 A1 6/2008 Braun
2014/0259831 A1 * 9/2014 Denby ..... G09F 15/0068 40/606.03
2016/0045041 A1 * 2/2016 Knudsen ..... E04F 11/16 211/59.4
2016/0286985 A1 10/2016 Shamp et al.
2018/0184816 A1 * 7/2018 Bellar ..... A47F 5/083
2018/0293919 A1 10/2018 Ertl et al.
2019/0021521 A1 1/2019 Kula
2019/0307266 A1 10/2019 Santarelli et al.

* cited by examiner

TIERED DISPLAY UNIT

BACKGROUND

Businesses, such as retail stores, use a variety of display structures to present products and related information to customers for purchase. Hang bars or crossbars are components that are used with display structures to support hanging products that are being offered for sale. These hang bars or crossbars fit with gondola display units or other types of display units to provide a structure for receiving hanging-type retail merchandise or for receiving other types of hardware and accessories that display merchandise.

The discussion above is merely provided for general background information and is not intended to be used as an aid in determining the scope of the claimed subject matter.

SUMMARY

A tiered display unit includes a frame assembly. The frame assembly includes a first side support structure having a plurality of support members that form at least one tier, a second side support structure having a plurality of support members that form at least one tier and a plurality of cross members that connect the first support structure to the second support structure. Select cross members of the plurality of cross members include a pair of elongated components that are spaced apart from each other and occupy an area that is the same as the non-selected cross members. The space between the pairs of elongated components of the select cross members are configured to receive hooks for mating display accessories to the frame assembly.

A tiered display unit includes a frame assembly and a plurality of display accessories. The frame assembly includes a first side support structure having a plurality of support members that form at least one tier, a second side support structure having a plurality of support members that form at least one tier and a plurality of cross members that connect the first support structure to the second support structure. One or more of the plurality of cross members includes a pair of elongated components that are spaced apart from each other and occupy an area that is the same as the cross members that do not have a pair of elongated components. The plurality of display accessories each have a hook for mating with the frame assembly. The space between the pairs of elongated components of the one or more cross members is configured to receive the hooks for mating the plurality of display accessories to the frame assembly.

A method of assembling a tiered display unit includes providing a frame assembly with at least one tier that has a plurality of cross members. One or more of the plurality of cross members are first cross members that include a pair of elongated components and one or more of the plurality of cross members are second cross member that do not have a pair of elongated components. The pair of elongated components of the first cross members are spaced apart from each other and occupy an area that is the same as the second cross members. A plurality of display accessories are mounted to the first cross members by inserting a hook located on each of the display accessories in between the pair of elongated components.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

A tiered display unit having a frame assembly is a freestanding display unit configured to display and to make merchandise available to customers in a retail store around its entire four-sided perimeter. The tiered display unit is configured to be furnished with multiple levels of display accessories that are supported by double-sided cross members. This means that from a single horizontal support location, display accessories may be simultaneously hung on a first side of the single horizontal support location and also on an opposing second side of the single horizontal support location. These double-sided cross members are seamlessly built into the frame assembly of the tiered display unit so if any portion of the double sided cross members are unused, the tiered display unit still appears aesthetically pleasing.

Figure 1:
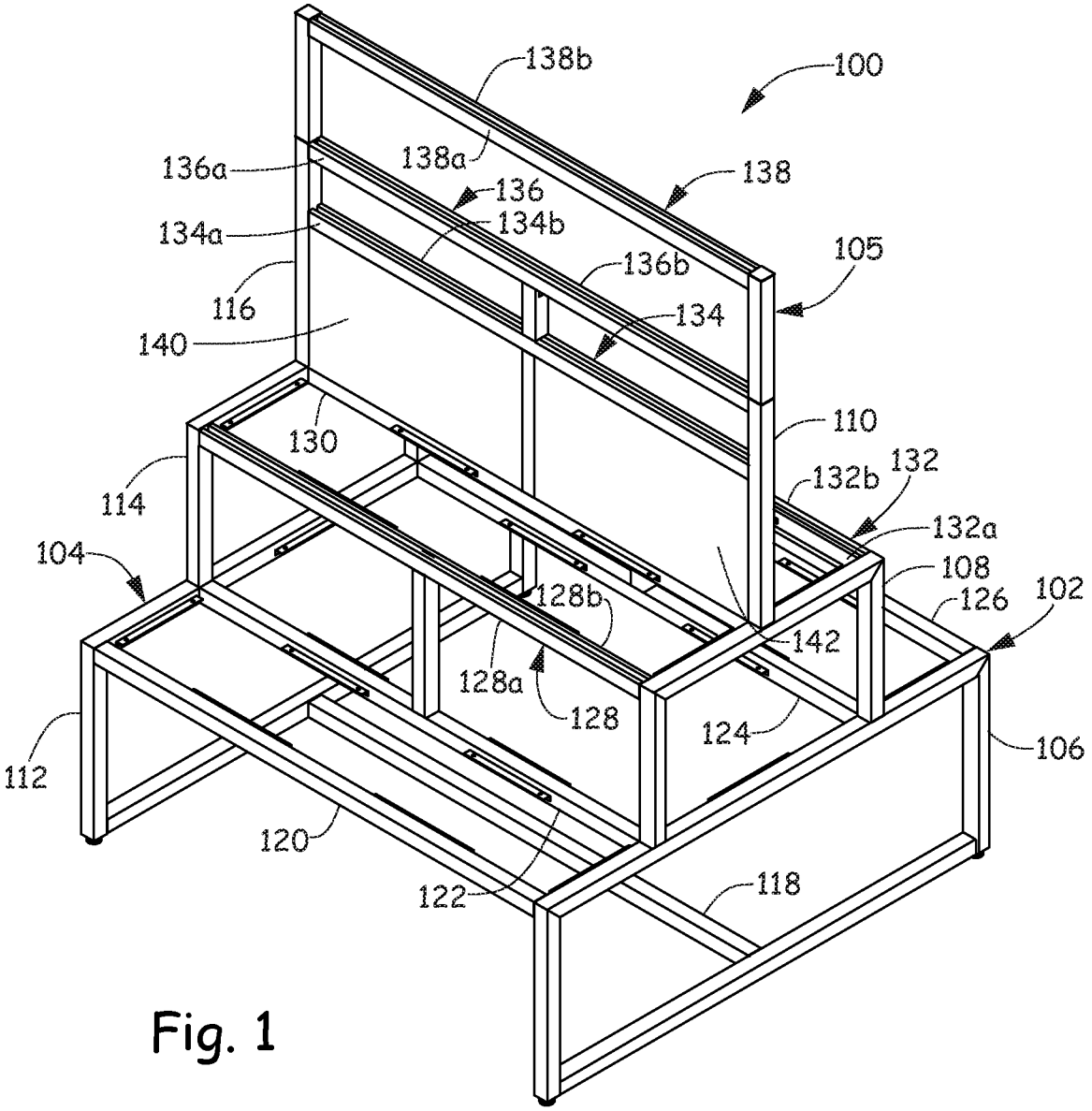
FIG. 1 is a perspective view of a frame assembly of a tiered display unit according to an embodiment.
Figure 2:
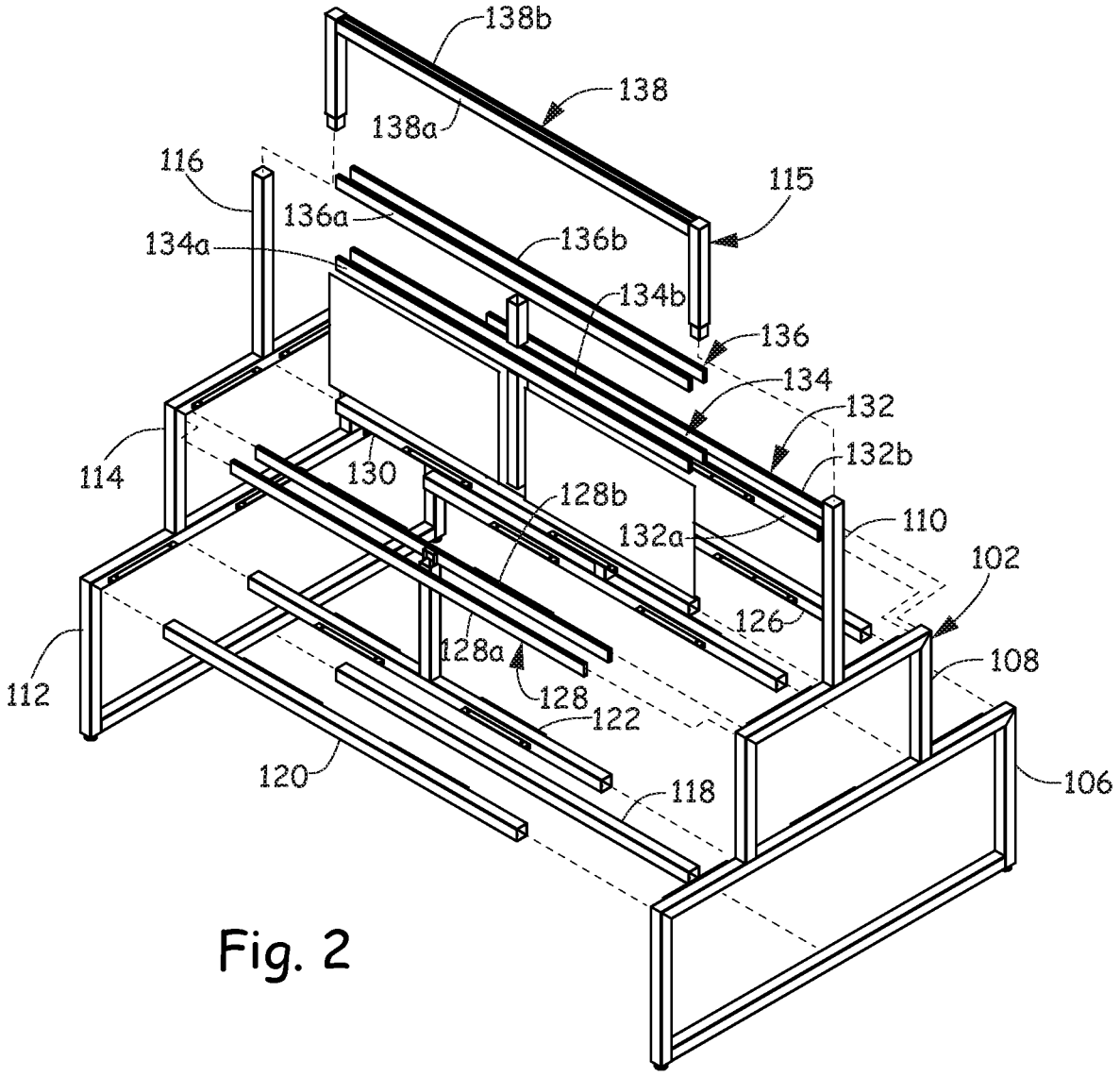
FIG. 2 is an exploded perspective view of the frame assembly of the tiered display unit of FIG. 1.
Figure 3:
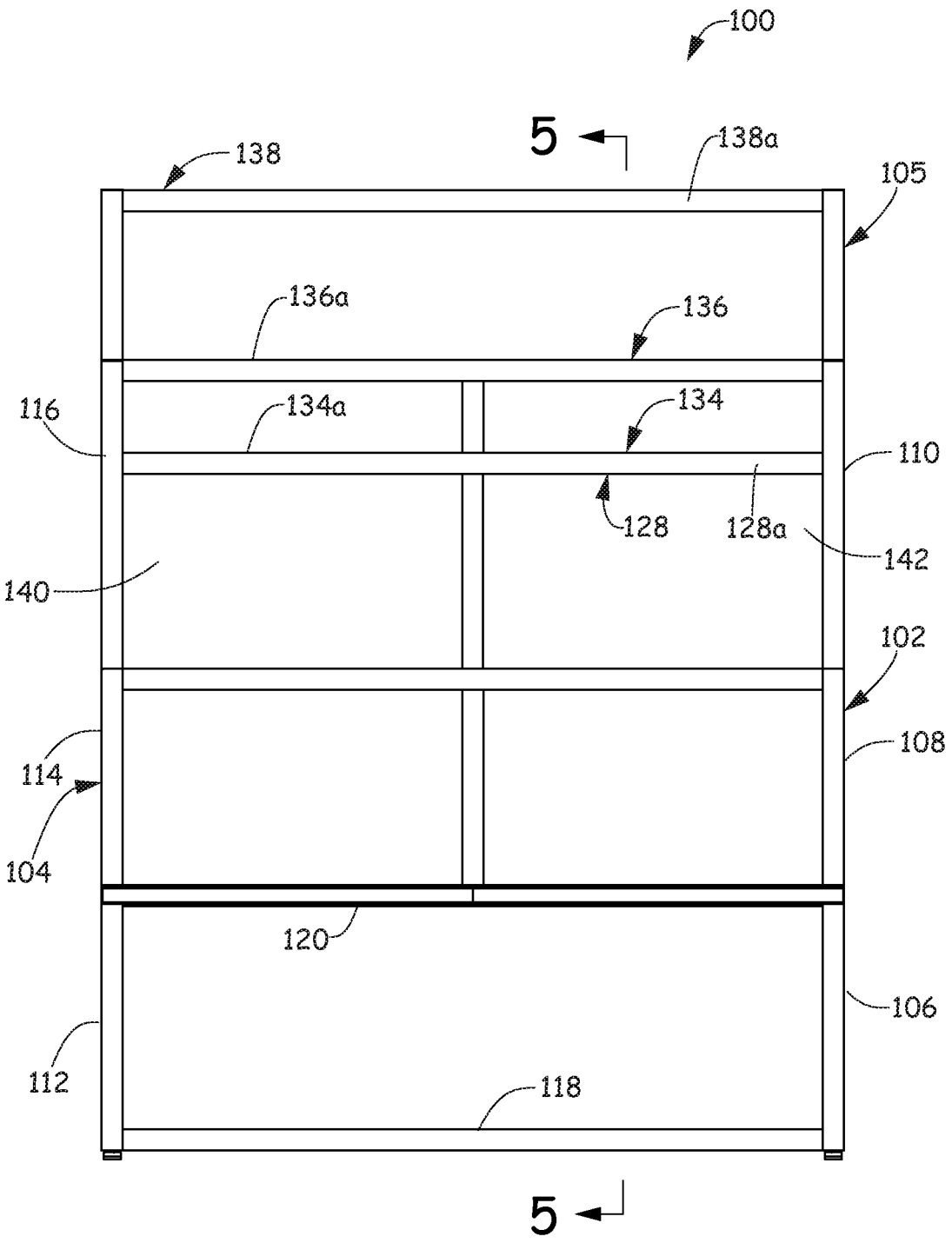
FIG. 3 is a front view of FIG. 1.
Figure 4:
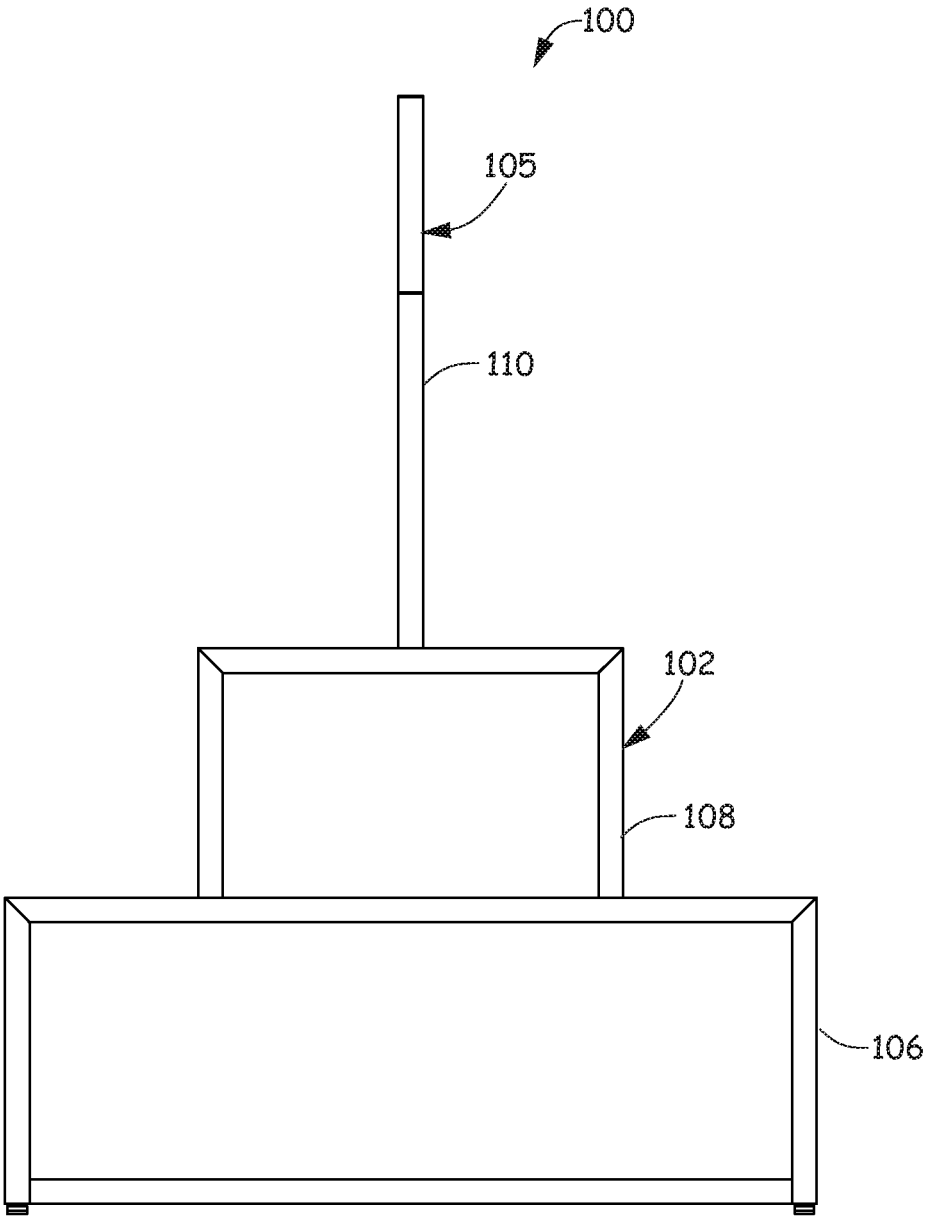
FIG. 4 is a right side view of FIG. 1, the left side view being identical.
Figure 5:
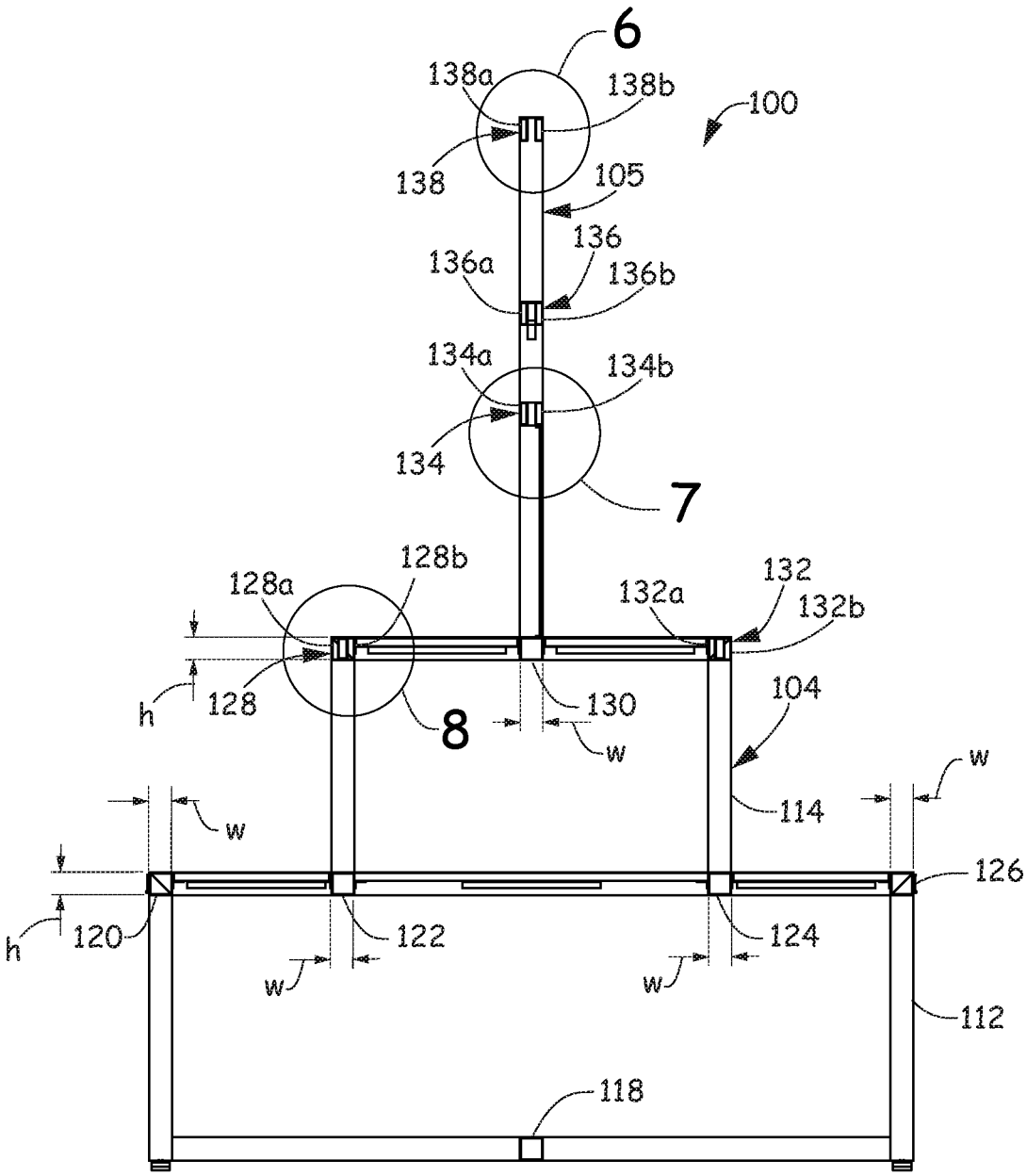
FIG. 5 is a section view of the frame assembly of the tiered display unit as indicated by the section line in FIG. 3.
Figure 6:
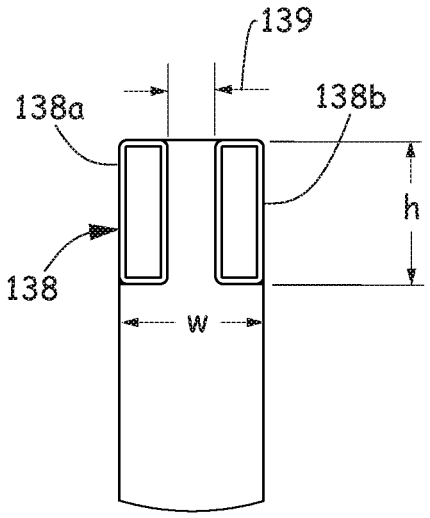
FIG. 6 is an enlarged view of a top portion of the frame illustrated in FIG. 5.
Figure 7:
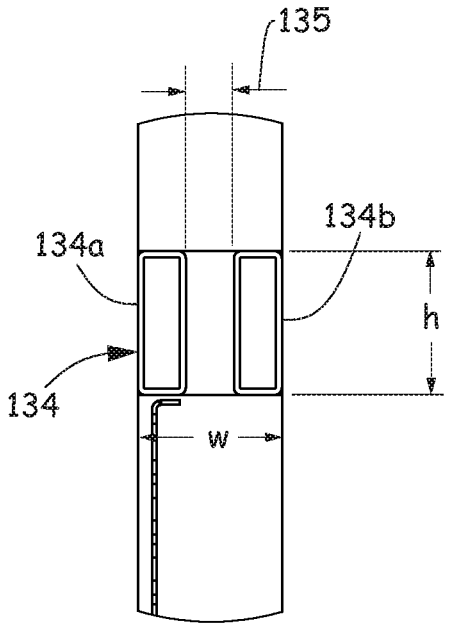
FIG. 7 is an enlarged view of a mid-portion of the frame illustrated in FIG. 5.
Figure 8:
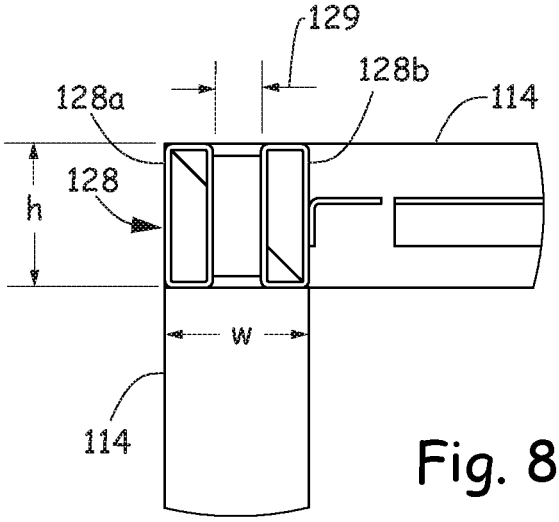
FIG. 8 is an enlarged view of a front portion of the frame illustrated in FIG. 5.

FIG. 1 is a perspective view of a frame assembly 100 of a tiered display unit (see FIGS. 9 and 10) according to an embodiment. FIG. 2 is an exploded perspective view, FIG. 3 is a front view and FIG. 4 is a right side view of frame assembly 100, where the left side view is identical. Frame assembly 100 includes a plurality of structural members that are assembled together to form frame assembly 100. FIG. 5 is a section view of frame assembly 100 of the tiered display unit as indicated by the section line in FIG. 3. FIGS. 6-8 are enlarged views of certain portions of FIG. 5.

Frame assembly 100 includes a plurality of support members that together form a first side support structure 102, a plurality of support members that together form a second side support structure 104, a plurality of cross members 118, 120, 122, 124, 126, 128, 130, 132, 134 and 136 and a removable sign holder 105. In the illustrated exemplary embodiment, right side support structure 102 includes a first tier 106 of four assembled support members, a second tier 108 of three assembled support members and a third tier 110 of one support member that protrudes vertically upward from second tier 108. Likewise, left side support structure 104 includes a first tier 112 of four assembled support members, a second tier 114 of three assembled support members and a third tier 116 of one support member that protrudes vertically upward from second tier 114 of left side support structure 104. While the embodiment shown in FIGS. 1-5 illustrates three tiers, it should be realized that frame assembly 100 may have at least one tier or any number of tiers.

Frame assembly 100 includes a plurality of cross members that connect right side support structure 102 to left side support structure 104. The plurality of cross members include a plurality of first tier cross members that couple first tier 106 of right side support structure 102 to first tier 112 of left side support structure 104. The first tier cross members include a lower first tier cross member 118 that couples a midpoint of a bottom of first tier 106 of right side support structure 102 to a midpoint of a bottom of first tier 112 of left side support structure 104. The first tier cross members also include upper first tier cross members 120, 122, 124 and 126. Upper first tier cross member 120 couples a front of first tier 106 of right side support structure 102 to a front of first tier 112 of left side support structure 104. Upper first tier cross member 126 couples a back of first tier 106 of right side support structure 102 to a back of first tier 112 of left side support structure 102. Upper first tier cross member 122 couples first tier 106 of right side support structure 102 to first tier 112 of left side support structure at points where fronts of second tiers 108 and 114 intersect with fronts of first tiers 106 and 112. Upper first cross member 124 couples first tier 106 of right side support structure 102 to first tier 112 of left side support structure at points where backs of second tiers 108 and 114 intersect with backs of first tiers 106 and 112.

The plurality of cross members also include a plurality of second tier cross members 128, 130 and 132 that couple second tier 108 of right support structure 102 to second tier 114 of left side support structure 104. Second tier cross member 128 couples a front of second tier 108 of right side support structure 102 to a front of second tier 114 of left side support structure 104 and second tier cross member 132 couples a back of second tier 108 of right side support structure 102 to a back of second tier 114 of left side support structure 104. Second tier cross member 130 couples a center of second tier 108 of right side support structure 102 to a center of second tier 114 of left side support structure 104.

The plurality of cross members also include a plurality of third tier cross members 134 and 136 that couple third tier 110 of right support structure 102 to third tier 116 of left support structure 104. Third tier cross member 134 couples a central area of third tier 110 of right side support structure 102 to a central area of third tier 116 of left side support structure 104 and third tier cross member 136 couples a top of third tier 110 of right side support structure 102 to a top of third tier 116 of left support structure 104.

The plurality of cross members include select cross members formed of a pair of elongated components that are spaced apart from each other. Each elongated component of these select cross members is thin enough to be spaced apart from each other by a distance, but still be located close enough together to occupy an area that is the same as the non-selected cross members. For example and as illustrated in FIGS. 5 and 6-8, cross members 120, 122, 124, 126 and 130 all have square cross sections including widths (w) that are the same as their heights (h) and include areas that are equal to w×h, while cross members 128, 132, 134, 136 and 138 have two elongated components that are spaced apart from each other but also occupy the same area as cross members 120, 122, 124 and 126 by having a combined width (w) and a height (h). These elongated components provide frame assembly 100 with added functionality and structure for receiving hooks on display accessories that mate to frame assembly 100 and will be described in more detail below.

Certain of these select cross members that have a pair of elongated components spaced apart from each other are capable of receiving hooks on display accessories that extend outwardly in two opposing directions. The hanging display accessories on these certain cross members may extend outwardly towards a front of frame assembly 100 and outwardly towards a back of frame assembly 100. In this way, these certain cross members may receive directly opposing hanging display accessories that allow for extending outwardly towards a front of frame assembly 100 and outwardly towards a back of frame assembly 100 on the same section of the cross member. Others of the select cross members that have a pair of elongated components spaced apart from each other are only capable of receiving hooks on display accessories that extend outward in a single direction. The hanging display accessories on these cross member may extend outwardly towards a front of frame assembly 100 or outwardly towards a back of frame assembly 100, but not both.

In the embodiment illustrated in FIGS. 1-5, second tier cross members 128 and 132 have a pair of elongated components 128*a*, 128*b* and 132*a*, 132*b*. Each component 128*a*, 128*b* and 132*a*, 132*b* is thin enough to be spaced apart from each other by a distance 129 (see FIG. 8, which is an enlarged view of a front portion of the frame illustrated in FIG. 5), but still be located close enough together to occupy the same area (w×h) as one of the plurality of first tier cross members 120, 122, 124 and 126. In this way, second tier cross members 128 and 132 appear to be like first tier cross members, but because of the two elongated components 128*a*, 128*b* and 132*a*, 132*b*, second tier cross members 128 and 132 have added functionality. Not only do they structurally support and connect components to form frame assembly 100, but they provide added functionality and structure for receiving hanging accessories. Second tier cross member 128 is configured to receive hooks for mating display accessories that can extend outwardly in a single direction towards a front of frame assembly 100. Second tier cross member 132 is configured to receive hooks for mating display accessories that can extend outwardly in a single direction towards a back of frame assembly 100. Second tier cross member 130 does not have a pair of elongated components.

In the embodiment illustrated in FIGS. 1-5, third tier cross members 134 and 136 have a pair of elongated components 134*a*, 134*b* and 136*a*, 136*b*. Each component 134*a*, 134*b* and 136*a*, 136*b* is thin enough to be spaced apart from each other by a distance 135 (see FIG. 7, which is an enlarged view of a mid-portion of the frame illustrated in FIG. 5), but still be located close enough together to occupy the same area (w×h) as one of the plurality of first tier cross members 120, 122, 124 and 126 and second tier cross members 128, 130 and 132. In this way, third tier cross members 134 and 136 are like second tier cross members 128 and 132 and have added functionality. Not only do they structurally support and connect components to form frame assembly 100, but they provide structure for receiving hanging accessories. Third tier cross member 134 is configured to receive hooks for mating hanging display accessories that can extend outwardly towards a front of frame assembly 100 and outwardly towards a back of frame assembly 100. Third tier cross member 136 is configured to receive hooks for mating hanging display accessories that can extend outwardly towards a front of frame assembly 100 and outwardly towards a back of frame assembly 100. In one embodiment, third tier cross members 134 and 136 may receive opposing hanging display accessories that allow for extending outwardly towards a front of frame assembly 100 and outwardly towards a back of frame assembly 100 on the same section of third tier cross members 134 and 136.

Removable sign holder 105 includes a cross member 138. Like cross members 128, 132, 134 and 136, cross member 138 also includes two elongated components 138*a* and 138*b*. Each component 138*a* and 138*b* is thin enough to be spaced apart from each other by a distance 139 (see FIG. 6, which is an enlarged view of a top portion of the frame illustrated in FIG. 5), but still be located close enough together to occupy the same area (w×h) as one of the plurality of first tier cross members 120, 122, 124, and 126, second tier cross members 128, 130 and 132 and third tier cross members 134 and 136. In this way, cross member 138 is like third tier cross members 134 and 136. Not only do they connect components to form frame assembly 100, but they provide structure for receiving hanging accessories. Cross member 138 is configured to receive hooks for mating hanging display accessories that can extend outwardly towards a front of frame assembly 100 and outwardly towards a back of frame assembly 100. In one embodiment, cross member 138 may receive opposing hanging display accessories that allow for extending outwardly towards a front of frame assembly 100 and outwardly towards a back of frame assembly 100 on the same section of cross member 138.

As illustrated in FIGS. 1-3, frame assembly 100 also includes a pair of panels 140 and 142. Panels 140 and 142 are located within the third tier of frame assembly and held in place between second tier cross member 130 and third tier cross member 134. Panels 140 and 142 prevent merchandise from migrating from the front of the second tier to the back of the second tier when horizontally oriented shelves are placed on the second tier. In one embodiment, panels 140 and 142 may be made of steel. In another embodiment, panels 140 and 142 are made of perforated steel.

Figure 9:
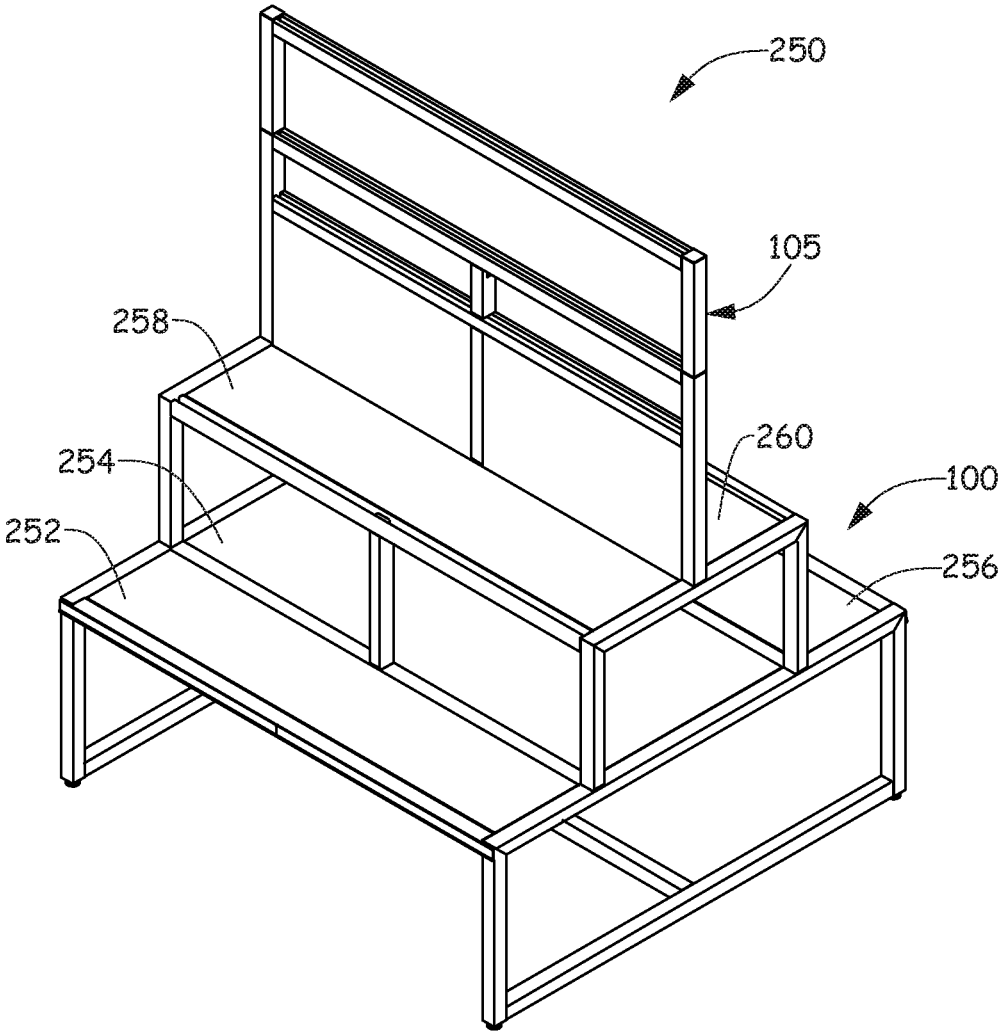
FIG. 9 is perspective view of a tiered display unit according to an embodiment.

FIG. 9 is perspective view of tiered display unit 250 according to an embodiment. Tiered display unit 250 includes frame assembly 100 and a plurality of shelf panels 252, 254, 256, 258 and 260 located on the first and second tiers of frame assembly 100 that form first and second tier shelves. As illustrated in FIGS. 1 and 2, interior facing portions of left support structure 102, right support structure 104 and cross members 120, 122, 124, 126, 128, 130 and 132 include brackets for supporting shelf panels so that the top surface of the panel is in alignment with the top surfaces of adjacent cross members and members of left and right support structures 102 and 104. In this embodiment, merchandise may be set on the shelf panels of tiered display unit 250 without any further accessories.

Figure 10:
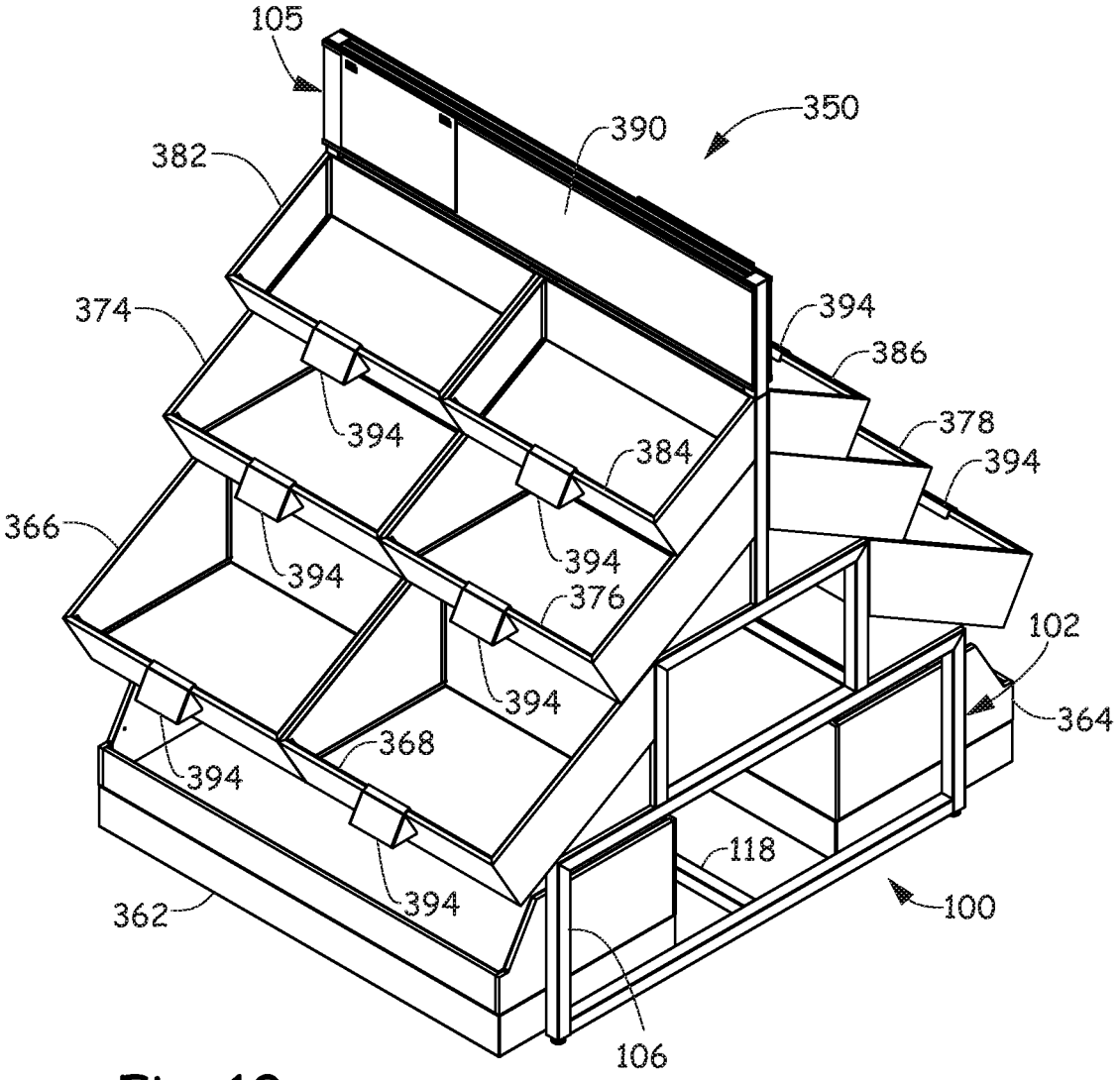
FIG. 10 is a perspective view of the tiered display unit according to an embodiment.
Figure 11:
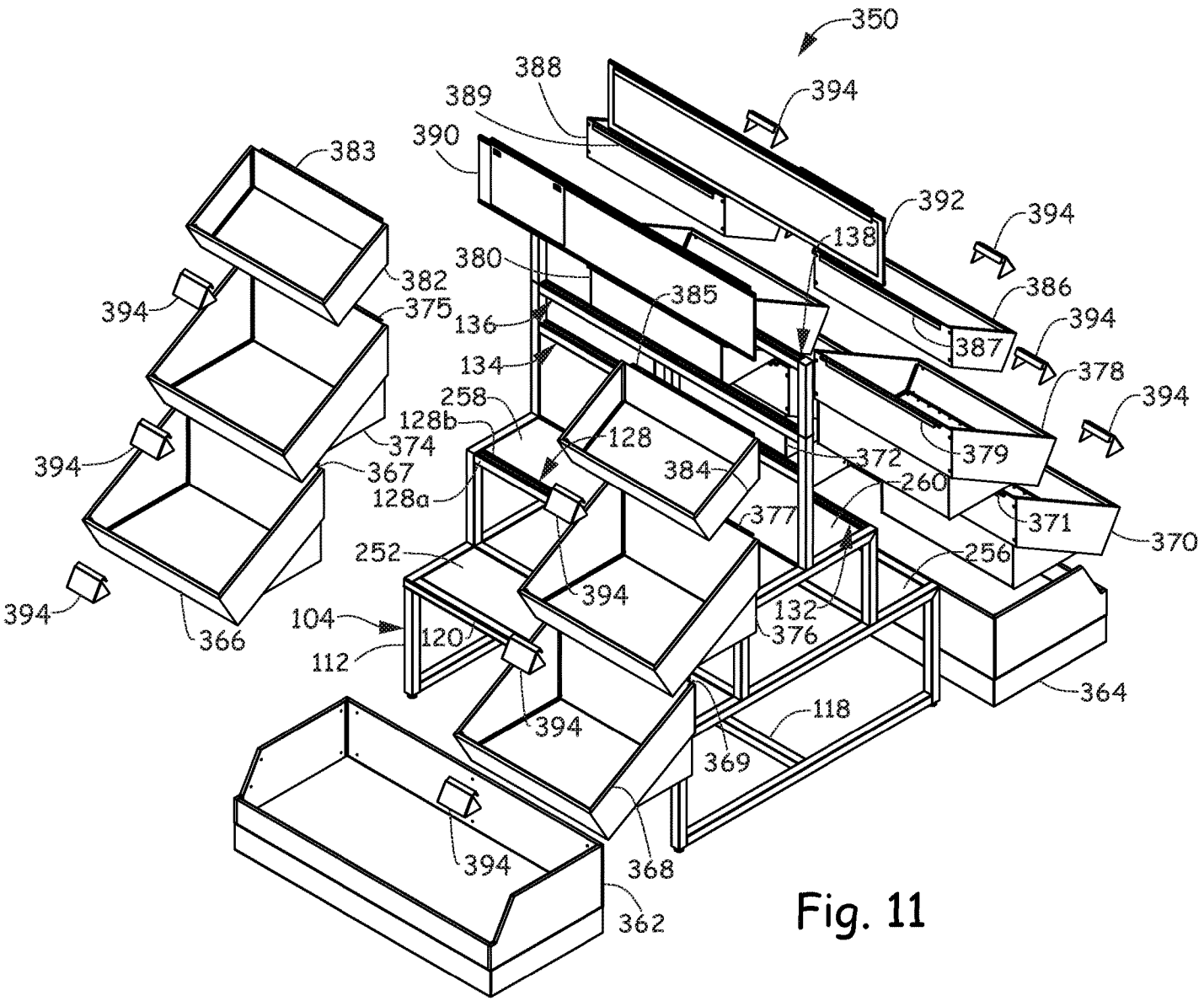
FIG. 11 is an exploded perspective of the tiered display unit in FIG. 10.
Figure 12:
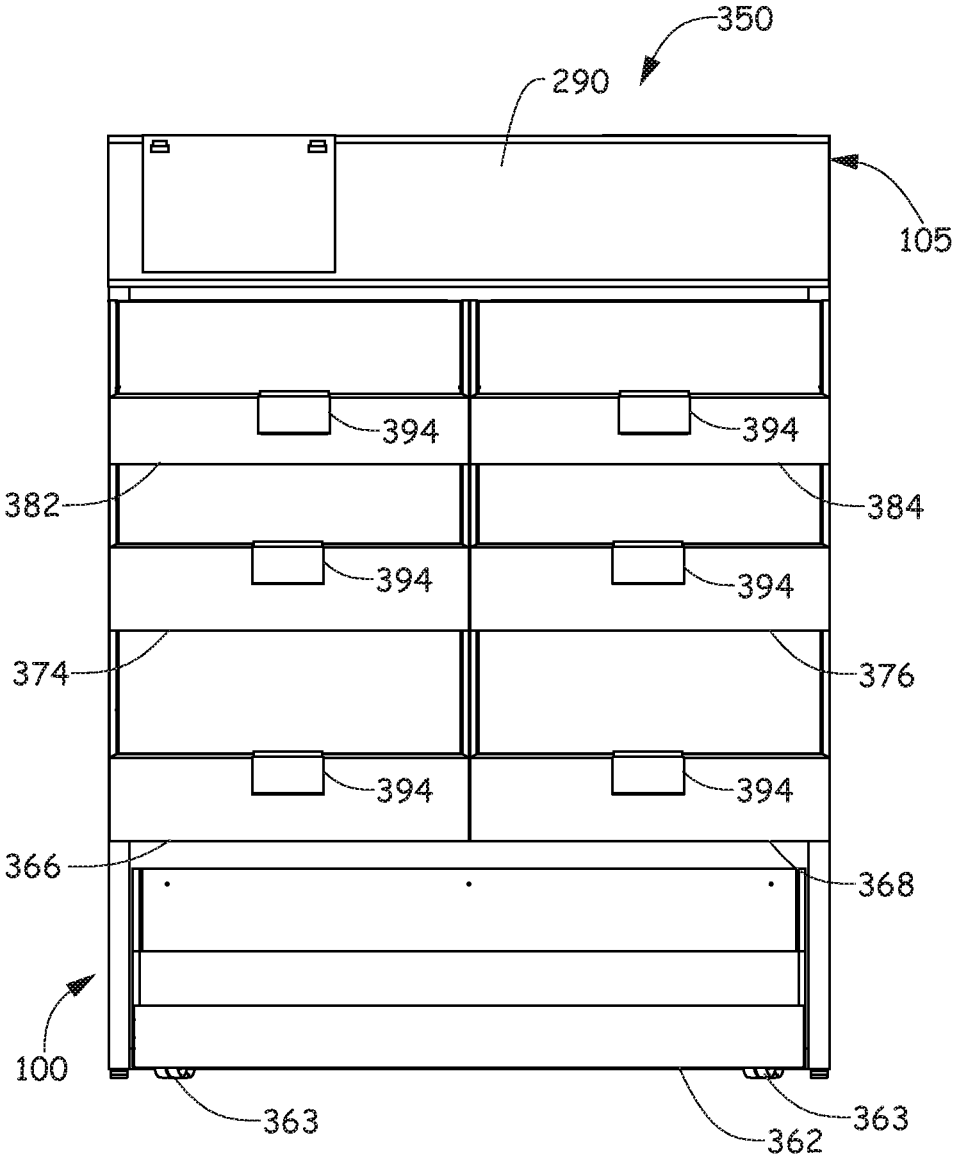
FIG. 12 is a front view of FIG. 10.
Figure 13:
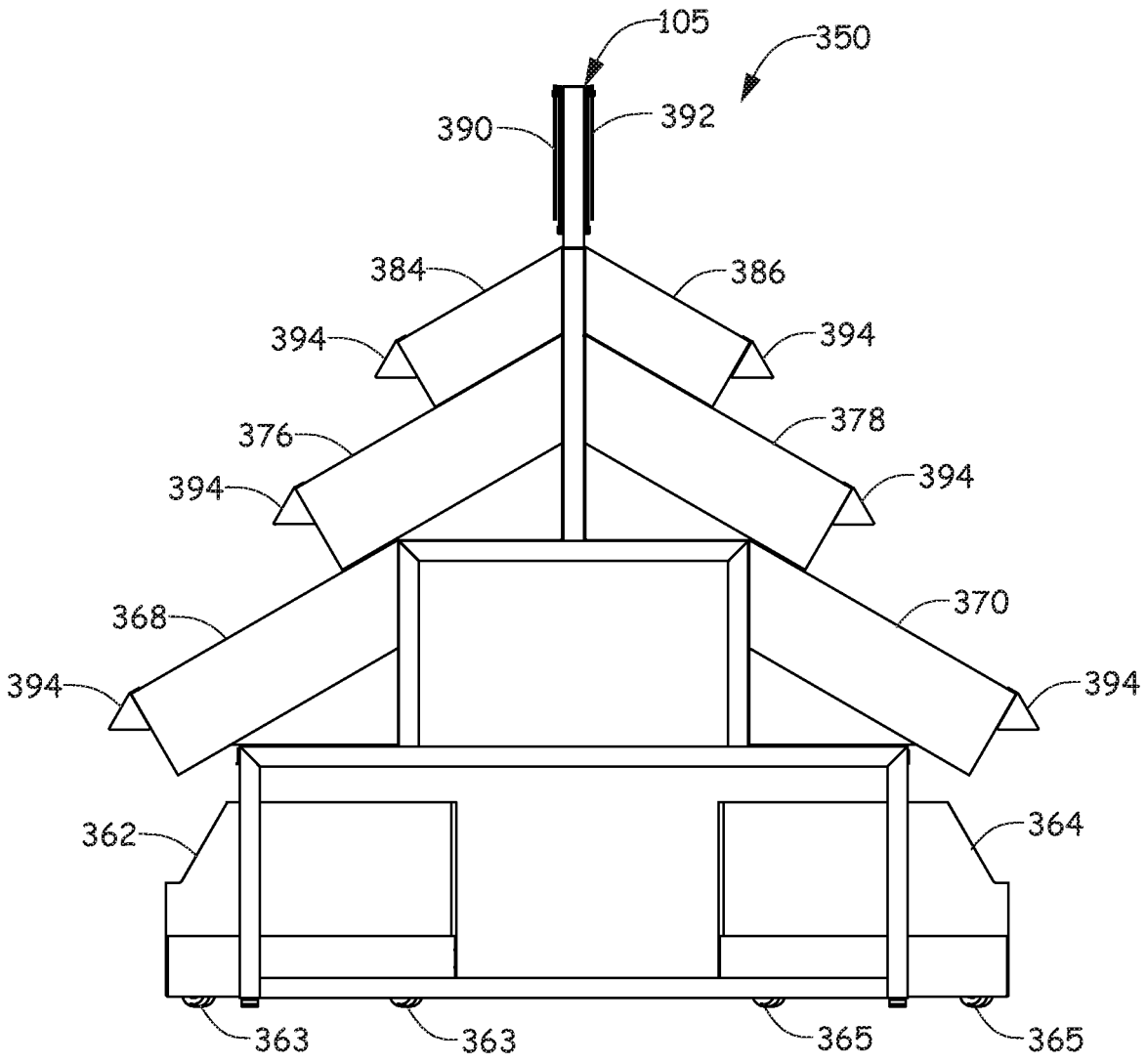
FIG. 13 is a right side view of FIG. 10, the left side view being identical.
Figure 14:
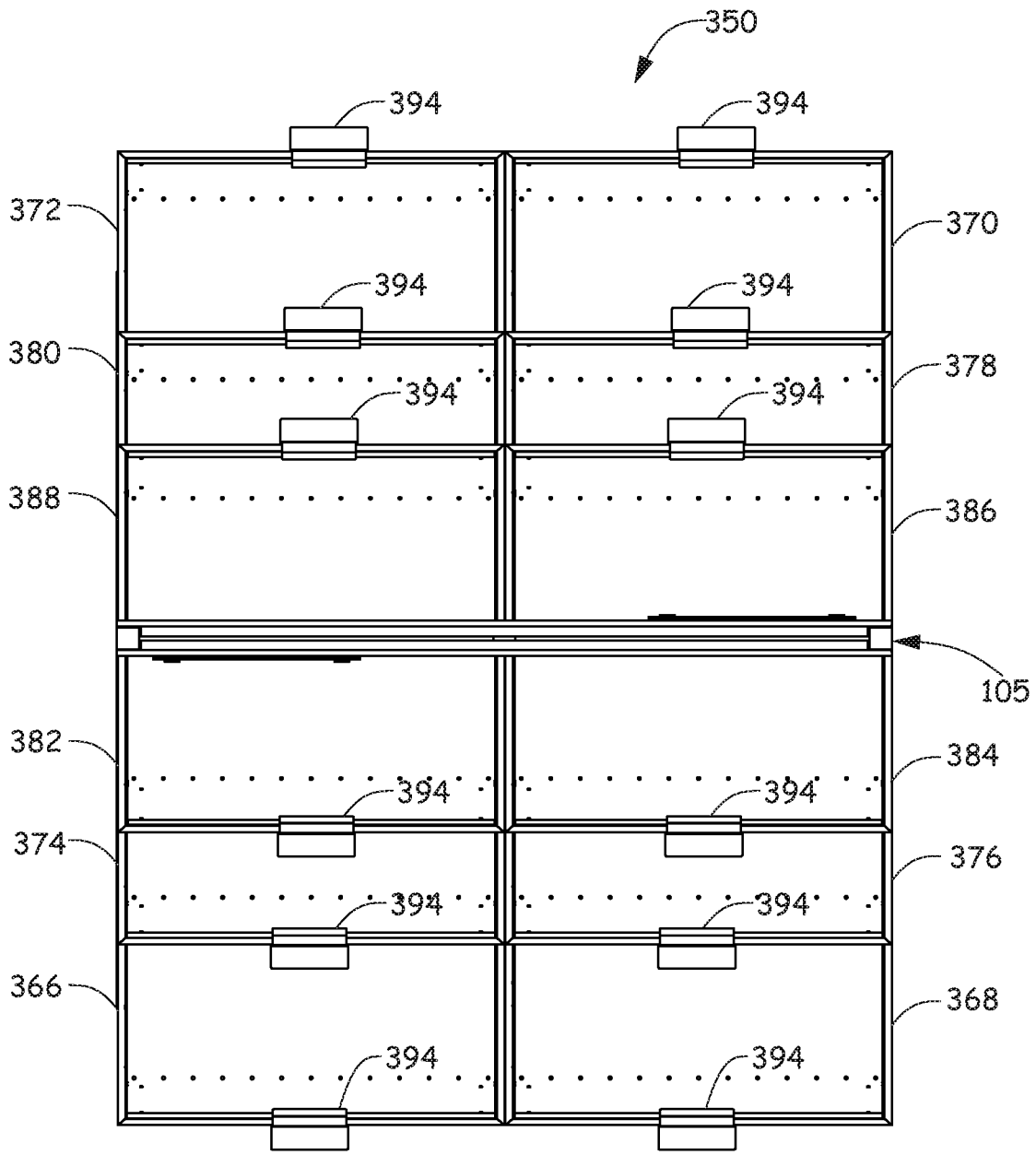
FIG. 14 is a top view of FIG. 10.

FIG. 10 is a perspective view of a tiered display unit 350 according to an embodiment. FIG. 11 is an exploded perspective, FIG. 12 is a front view, FIG. 13 is a right side view (the left side view being identical) and FIG. 14 is a top view of tiered display unit 350. Tiered display unit 350 includes frame assembly 100 of FIGS. 1-4, shelf panels 252, 254, 256, 258 and 260 of FIG. 9, a plurality of display accessories 362, 364, 366, 368, 370, 372, 374, 376, 378, 380, 382, 384, 386 and 388 in the form of display bins, a pair of opposing signs 390 and 392 located in removable sign holder 105 and a plurality of signs 394.

Display accessories 362 and 364 are display bins located on rollers 363 and 365, respectively (See FIGS. 12 and 13). Rollers 363 and 365 allow display bins 362 and 364 to be movable under the first tier of frame assembly 100. In particular, display bin 362 is located between first tier 106 of right side support structure 102 and first tier 112 of left side support structure 104. Display bin 362 is also located between lower first tier cross member 118 and a front of frame assembly 100. Rollers 363 allow display bin 362 to be rolled forwards from lower first tier cross member 118 so that, in some embodiments, a front of display bin 362 is positioned forward of the front of upper first tier cross member 120. Display bin 364 is located between first tier 106 of right side support structure 102 and first tier 112 of left side support structure 104. Display bin 362 is also located between lower first tier cross member 118 and a back of frame assembly 100. Rollers 365 allow display bin 364 to be rolled backwards from lower first tier cross member 118 so that, in some embodiments, a back of display bin 364 is positioned backward of the back of upper first tier cross member 126.

As illustrated in FIGS. 10-14, display accessories 366, 368, 370, 372, 374, 376, 378, 380, 382, 384, 386 and 388 are display bins each having a hook on their back, exterior sides. In the alternative, the display accessories can be other types of merchandise supporting structures, such as display shelves. No matter the type, each display accessory includes the hook at the back for mating with one of cross members 128, 132, 134, 136 and 138 where each cross member 128, 132, 134, 136 and 138 has two spaced apart elongated components. For example, hook 367 of display bin 366 mates with cross member 128 by inserting hook 367 in between elongated components 128*a* and 128*b* and fastening hook 367 around elongated component 128*a*. Hook 369 of display bin 368 mates with cross member 128 by inserting hook 369 in between elongated components 128*a* and 128*b* and fastening hook 369 around elongated component 128*a*. Hook 371 of display bin 370 mates with cross member 132 by inserting hook 371 in between elongated components 132*a* and 132*b* and fastening hook 371 around elongated component 132*b*. The hook of display bin 372 (hidden from view) mates with cross member 132 by inserting the hook in between elongated components 132*a* and 132*b* and fastening the hook around elongated component 132*b*. Hook 375 of display bin 374 mates with cross member 134 by inserting hook 375 in between elongated components 134*a* and 134*b* and fastening hook 375 around elongated component 134*a*. Hook 377 of display bin 376 mates with cross member 134 by inserting hook 377 in between elongated components 134*a* and 134*b* and fastening hook 377 around elongated component 134*a*. Hook 379 of display bin 378 mates with an opposing side of cross member 134 from hook 377 of display bin 376 by inserting hook 379 in between elongated components 134*a* and 134*b* and fastening hook 379 around elongated component 134*b*. The hook of display bin 380 (hidden from view) mates with an opposing side of cross member 134 from hook 375 of display bin 374 by inserting the hook in between elongated components 134*a* and 134*b* and fastening the hook around elongated component 134*b*. Hook 383 of display bin 382 mates with cross member 136 by inserting hook 383 in between elongated components 136*a* and 136*b* and fastening hook 383 around elongated component 136*a*. Hook 385 of display bin 384 mates with cross member 136 by inserting hook 385 in between elongated components 136*a* and 136*b* and fastening hook 385 around elongated component 136*a*. Hook 387 of display bin 386 mates with an opposing side of cross member 136 from hook 385 of display bin 386 by inserting hook 387 in between elongated components 136*a* and 136*b* and fastening hook 387 around elongated component 136*b*. Hook 389 of display bin 388 mates with an opposing side of cross member 136 from hook 383 of display bin 382 by inserting hook 389 in between elongated components 136*a* and 136*b* and fastening hook 389 around elongated component 136*b*. In the embodiment illustrated in FIGS. 10-14, cross member 138 does not receive hooks from display accessories. However, cross member 138 may receive hooks from display accessories and those hooks would be inserted in between elongated component 138*a* and elongated component 138*b* and would fasten around elongated component 138*a* or 138*b*.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A tiered display unit comprising:

a frame assembly comprising:

a first side support structure having a plurality of horizontally and vertically oriented support members coupled together to form at least one tier, wherein each support member of the first side support structure is defined by a length, a width and a height;

a second side support structure having a plurality of horizontally and vertically oriented support members coupled together to form at least one tier, wherein each support member of the second side support structure is defined by a length, a width that is equal to the width of each support member of the first side support structure and a height that is equal to the height of each support member of the second side support structure;

a plurality of cross members that connect the first support structure to the second support structure and provide the frame assembly with an opposing front and a back, each cross member being defined by a length, a width and a height, wherein the width of each cross member is equal to the width of each support member of the first side support structure and the width of each support member of the second side support structure, wherein the height of each cross member equal to the height of each support member of the first side support structure and the height of each support member of the second side support structure;

wherein select cross members of the plurality of cross members include a pair of elongated components spaced widthwise apart from each other by a distance that is less than the width of each cross member and the pair of elongated components have a height that is equal to the height of each cross member; and a removable sign holder that extends between the first side support structure and the second side support structure and includes a cross member having a pair of elongated components that are spaced apart from each other and are configured to receive hooks for mating to display accessories;

wherein the space between the pairs of elongated components of the select cross members are configured to receive hooks for mating display accessories to the frame assembly.

2. The tiered display unit of claim 1, wherein certain of the pairs of elongated components of the select cross members are configured to receive a first hook of a first display accessory that fastens around a first of the pair of elongated components of the select cross members and are configured to receive a second hook of a second display accessory that fastens around a second of the pair of elongated components such that the first and the second display accessories are configured to oppose each other relative to the select cross member.

3. The tiered display unit of claim 1, wherein the first side support structure and the second side support structure form at least first tiers and second tiers, wherein at least two of the cross members connect the first tier of the first side support structure with the first tier of the second side support structure and are configured to receive a shelf panel to form a first tier shelf.

4. The tiered display unit of claim 3, wherein one of the at least two cross members that connect the first tier of the first support structure with the first tier of the second side support structure comprise one of the select cross members having the pair of elongated components that are spaced apart from each other and are configured to receive hooks for mating to display accessories.

5. The tiered display unit of claim 1, wherein the first side support structure and the second side support structure form at least first tiers and second tiers, wherein at least two of the cross members connect the first tier of the first side support structure with the first tier of the second side support structure and at least two of the cross members connect the second tier of the first side support structure with the second tier of the second side support structure, the at least two cross members that connect the second tier of the first side support structure with the second tier of the second side support structure are configured to receive a shelf panel to form a second tier shelf.

6. The tiered display unit of claim 5, wherein one of the at least two cross members that connect the second tier of the first support structure with the second tier of the second side support structure comprise one of the select cross members having the pair of elongated components that are spaced apart from each other and are configured to receive hooks for mating to display accessories.

7. The tiered display unit of claim 1, wherein the first side support structure and the second side support structure form at least first tiers, second tiers and third tiers, wherein at least two of the cross members connect the first tier of the first side support structure with the first tier of the second side support structure, at least two of the cross members connect the second tier of the first side support structure with the second tier of the second side support structure and at least one of the cross members connect the third tier of the first side support structure with the third tier of the second side support structure, the at least one cross member that connects the third tier of the first side support structure with the third tier of the second side support structure comprises one of the select cross members having the pair of elongated components that are spaced apart from each other and are configured to receive hooks for mating to display accessories.

8. The tiered display unit of claim 7, wherein the pair of elongated components of the select cross member that connects the third tier of first side support structure and the third tier of the second side support structure is configured to receive a first hook of a first display accessory that fastens around a first of the pair of elongated components and is configured to receive a second hook of a second display accessory that fastens around a second of the pair of elongated components such that the first and the second display accessories are configured to oppose each other relative to the select cross member.

9. The tiered display unit of claim 1, wherein the first side support structure and the second side support structure form at least first, second and third tiers, wherein at least one of the cross members connects the third tier of the first side support structure with the third tier of the second side support structure and comprises one of the select cross members having the pair of elongated components that are spaced apart from each other and are configured to receive hooks for mating to display accessories.

10. The tiered display unit of claim 9, wherein the pair of elongated components of the select cross member that connects the third tier of first side support structure and the third tier of the second side support structure are configured to receive a first hook of a first display accessory that fastens around a first of the pair of elongated components and configured to receive a second hook of a second display accessory that fastens around a second of the pair of elongated components such that the first and the second display accessories are configured to oppose each other relative to the select cross member.

11. A tiered display unit comprising:

a frame assembly comprising:

a first side support structure having a plurality of support members coupled together to form at least one tier, wherein each support member of the first side support structure is defined by a length, a width and a height;

a second side support structure having a plurality of support members coupled together to form at least one tier, wherein each support member of the second side support structure is defined by a length, a width that is equal to the width of each support member of the first side support structure and a height that is equal to the height of each support member of the second side support structure;

a plurality of cross members that connect the first support structure to the second support structure and provide the frame assembly with an opposing front and a back, each cross member being defined by a length, a width and a height, wherein the width of each cross member is equal to the width of each support member of the first side support structure and the width of each support member of the second side support structure, wherein the height of each cross member is equal to the height of each support member of the first side support structure and the height of each support member of the second side support structure;

wherein one or more of the plurality of cross members are select cross members that include a pair of elongated components that are spaced widthwise apart from each other by a distance that is less than the width of each cross member and the pair of elongated components have a height that is equal to the height of each cross member;

a removable sign holder that extends between the first side support structure and the second side support structure and includes a cross member having a pair of elongated components that are spaced apart from each other; and a plurality of display accessories each having a hook, wherein the space between the pairs of elongated components of the one or more cross members and the cross member of the removable sign holder is configured to receive the hooks for mating the plurality of display accessories to the frame assembly and the removable sign holder.

12. The tiered display unit of claim 11, wherein certain of the pairs of elongated components of the select cross members are configured to receive a first hook of a first display accessory that fastens around a first of the pair of elongated components of the select cross members and configured to receive a second hook of a second display accessory that fastens around a second of the pair of elongated components such that the first and the second display accessories are configured to oppose each other relative to the select cross member.

13. The tiered display unit of claim 11, wherein the first side support structure and the second side support structure form at least first and second tiers.

14. The tiered display unit of claim 13, wherein one of at least two cross members that connect the second tier of the first support structure with the second tier of the second side support structure comprise one of the select cross members having the pair of elongated components that are spaced apart from each other and are configured to receive hooks for mating to display accessories.

* * * * *